US009713866B2

(12) United States Patent
Su et al.

(10) Patent No.: US 9,713,866 B2
(45) Date of Patent: Jul. 25, 2017

(54) PNEUMATIC RATCHET WRENCH HAVING A SHRUNK HEAD SECTION

(71) Applicant: Basso Industry Corp., Taichung (TW)

(72) Inventors: San-Yih Su, Taichung (TW); Da-Jay Lin, Taichung (TW)

(73) Assignee: Basso Industry Corp., Taichung (TW)

( * ) Notice: Subject to any disclaimer, the term of this patent is extended or adjusted under 35 U.S.C. 154(b) by 740 days.

(21) Appl. No.: 14/029,080

(22) Filed: Sep. 17, 2013

(65) Prior Publication Data

US 2014/0083256 A1 Mar. 27, 2014

(30) Foreign Application Priority Data

Sep. 21, 2012 (TW) ..... 101218352 U

(51) Int. Cl.

| | |
|---|---|
| ***B25B 17/00*** | (2006.01) |
| ***B25B 21/00*** | (2006.01) |
| *B25B 17/02* | (2006.01) |
| *B25B 23/00* | (2006.01) |

(52) U.S. Cl.

CPC ..... *B25B 21/004* (2013.01); *B25B 21/005* (2013.01); *B25B 17/02* (2013.01); *B25B 23/0078* (2013.01)

(58) Field of Classification Search

CPC . B25B 21/004; B25B 21/005; B25B 23/0078; B25B 17/00; B25B 21/002; B25B 17/02; B25B 21/00

USPC ..... 81/57.39, 57.11, 57, 57.13, 57.14

See application file for complete search history.

(56) References Cited

U.S. PATENT DOCUMENTS

| | | | | |
|---|---|---|---|---|
| 2,508,568 | A * | 5/1950 | Ellison | B25B 13/467 60/594 |
| 2,719,446 | A * | 10/1955 | Ford | B25B 21/004 81/179 |
| RE33,711 | E * | 10/1991 | Ono | B25B 21/02 173/93.5 |
| 5,237,885 | A * | 8/1993 | Putney | B25B 13/465 74/116 |
| 5,535,646 | A * | 7/1996 | Allen | B25B 21/004 81/57.39 |
| 6,640,669 | B2 | 11/2003 | Izumisawa | |
| 6,789,448 | B2 * | 9/2004 | Ono | B25B 21/004 81/57.13 |
| 6,860,174 | B2 * | 3/2005 | Kusama | B25B 21/004 81/57.13 |
| 7,475,609 | B2 * | 1/2009 | Liaw | B25B 21/004 74/116 |
| 8,051,746 | B2 * | 11/2011 | Bouchard | B25B 21/004 81/57.39 |

(Continued)

*Primary Examiner* — Larry E Waggle, Jr.
*Assistant Examiner* — Danny Hong
(74) *Attorney, Agent, or Firm* — Schwegman Lundberg & Woessner, P.A.

(57) ABSTRACT

A pneumatic ratchet wrench includes a main body, an output unit, a driving unit, and a transmission unit. The main body has a handle section and a shrunk head section narrower than the handle section. The output unit includes a driving head for outputting a power. At least a major portion of the output unit is disposed within the shrunk head section. The driving unit is disposed within the main body for generating the power pneumatically. The transmission unit is disposed within the handle section for transmitting the power to the driving head.

5 Claims, 5 Drawing Sheets

(56) References Cited

U.S. PATENT DOCUMENTS

| | | | | |
|---|---|---|---|---|
| 8,708,119 | B2 * | 4/2014 | Su | F16D 41/08<br>192/43.1 |
| 8,757,031 | B2 * | 6/2014 | Su | B25B 21/004<br>81/57.11 |
| 2003/0213340 | A1 * | 11/2003 | Alden | B25B 13/467<br>81/57.29 |
| 2005/0051002 | A1 * | 3/2005 | Brun | B25B 21/004<br>81/57.39 |

* cited by examiner

PNEUMATIC RATCHET WRENCH HAVING A SHRUNK HEAD SECTION

CROSS-REFERENCE TO RELATED APPLICATION

This application claims priority of Taiwanese Application No. 101218352, filed on Sep. 21, 2012.

BACKGROUND OF THE INVENTION

1. Field of the Invention

This invention relates to a pneumatic ratchet wrench, and more particularly to a pneumatic ratchet wrench having a shrunk head section.

2. Description of the Related Art

Referring to FIGS. 1 and 2, a pneumatic ratchet wrench 1 disclosed in U.S. Pat. No. 6,640,669 includes a main body 11, a driving head 12 rotatable about a Z-axis and projecting from the main body 11, a ratchet unit 13, and two racks 14 each extending along a direction parallel to a central axis (X), and a motor assembly 15. The main body 11 has an intake passage 111 communicated fluidly with an air pressure source (not shown). The ratchet unit 13 includes a yoke 131 disposed around and geared to the driving head 12, a pawl 132 disposed between the driving head 12 and the yoke 131 and rotatable for controlling the rotational direction of the driving head 12, and a reverse gear 133 connected to the pawl 132. One of the racks 14 is operated by an external force to move between a meshing position, where it can rotate the reverse gear 133, and a non-meshing position, where it cannot rotate the reverse gear 133. The motor assembly 15 includes a cylinder 151 in fluid communication with the intake passage 111, a rotor 152 disposed pivotally within the cylinder 151 and driven pneumatically to rotate about an X-axis, and an eccentric shaft 153 connected between the rotor 152 and the yoke 131.

As such, when the eccentric shaft 153 is driven by the rotor 152 to rotate about the X-axis, the yoke 131 swings about the Z-axis to rotate the driving head 12 in a single direction for outputting a power.

Since the racks 14 are located respectively at two sides of the reverse gear 133, the width (L) of a front end portion of the main body 11 must be greater than maximum width of an assembly of the racks 14 and the reverse gear 133 such that the racks 14 and the ratchet unit 13 can be received within the front end portion of the main body 11. As a result, the front end portion of the main body 10 cannot be extended into a narrower space, thereby limiting the applicable range of the pneumatic ratchet wrench.

SUMMARY OF THE INVENTION

The object of this invention is to provide a pneumatic ratchet wrench that has a shrunk head section so that it can be operated easily and conveniently in a narrower space.

According to this invention, a pneumatic ratchet wrench includes a main body, an output unit, a driving unit, and a transmission unit. The main body has a handle section and a shrunk head section narrower than the handle section. The output unit includes a driving head for outputting a power. At least a major portion of the output unit is disposed within the shrunk head section. The driving unit is disposed within the main body for generating the power pneumatically. The transmission unit is disposed within the handle section for transmitting the power to the driving head.

The pneumatic ratchet wrench is advantageous in that, since the shrunk head section receives only the output unit, the width thereof can be reduced significantly, so that the pneumatic ratchet wrench is suitable for operation in a narrower space, thereby resulting in convenience during use.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
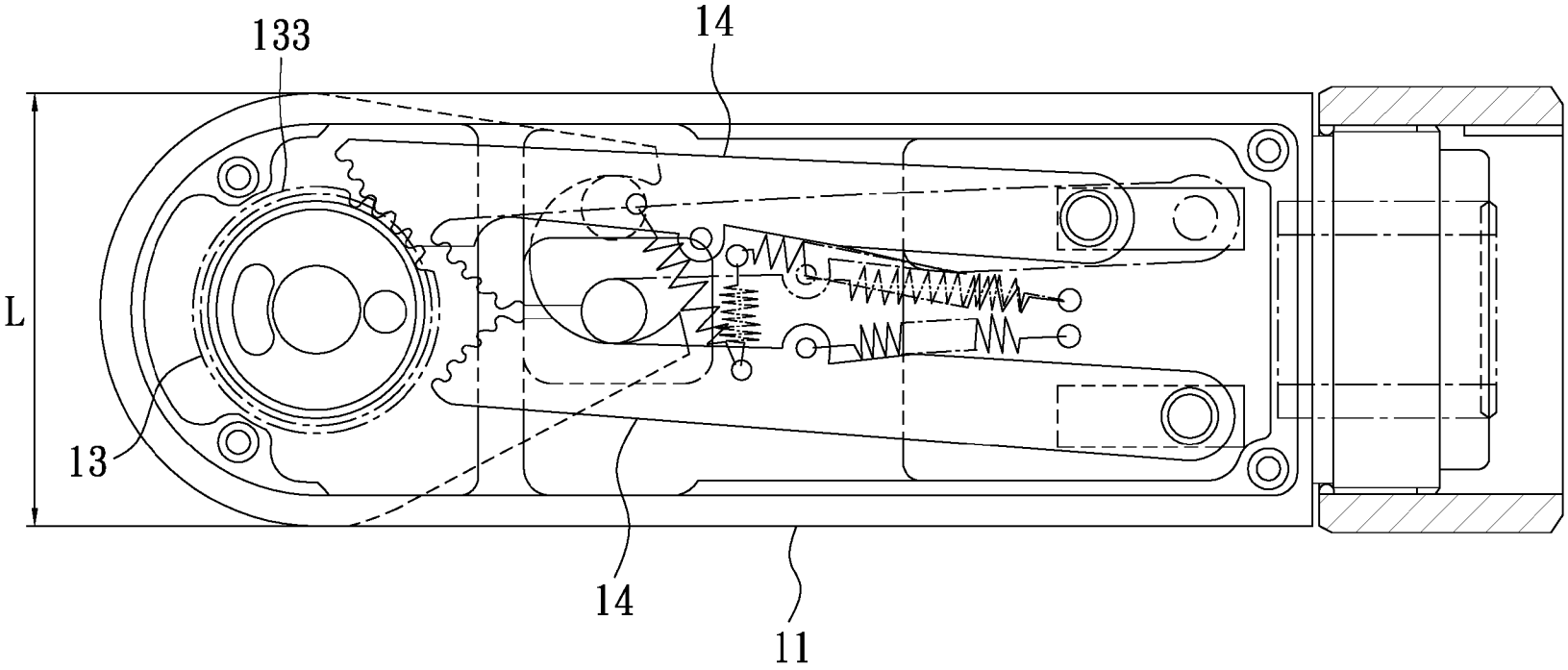
FIG. 1 PRIOR ART
FIG. 1 is a top view of a conventional pneumatic ratchet wrench disclosed in U.S. Pat. No. 6,640,669.
Figure 2:
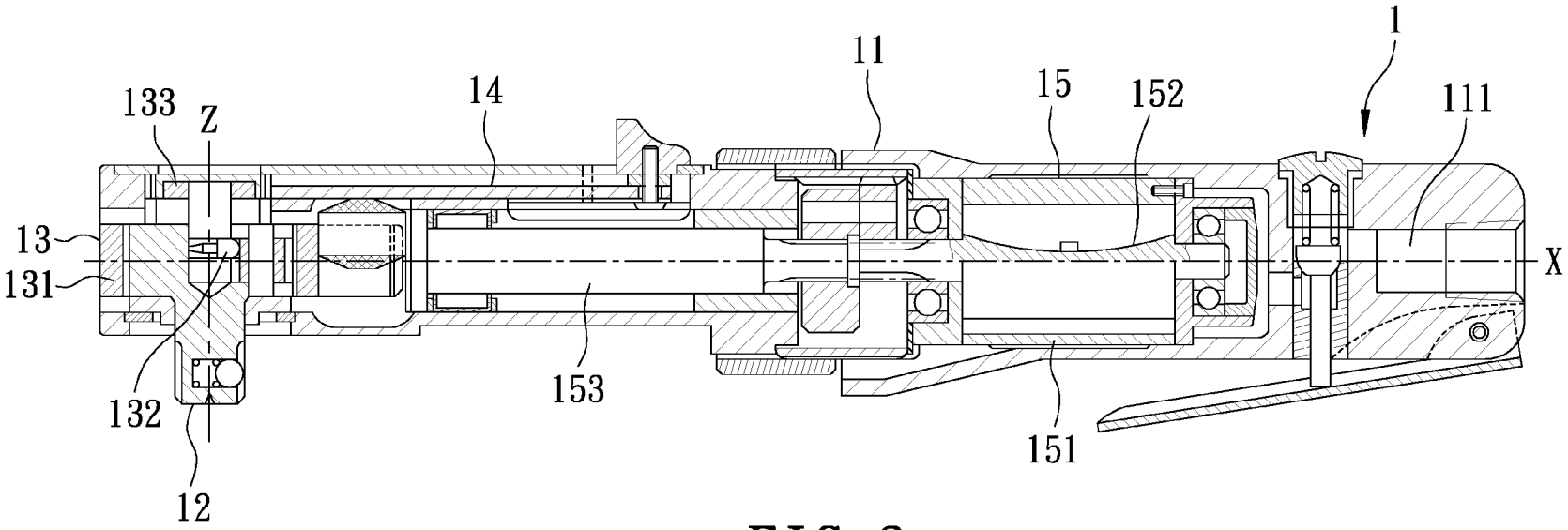
FIG. 2 PRIOR ART
FIG. 2 is a sectional view of the conventional pneumatic ratchet wrench.
Figure 3:
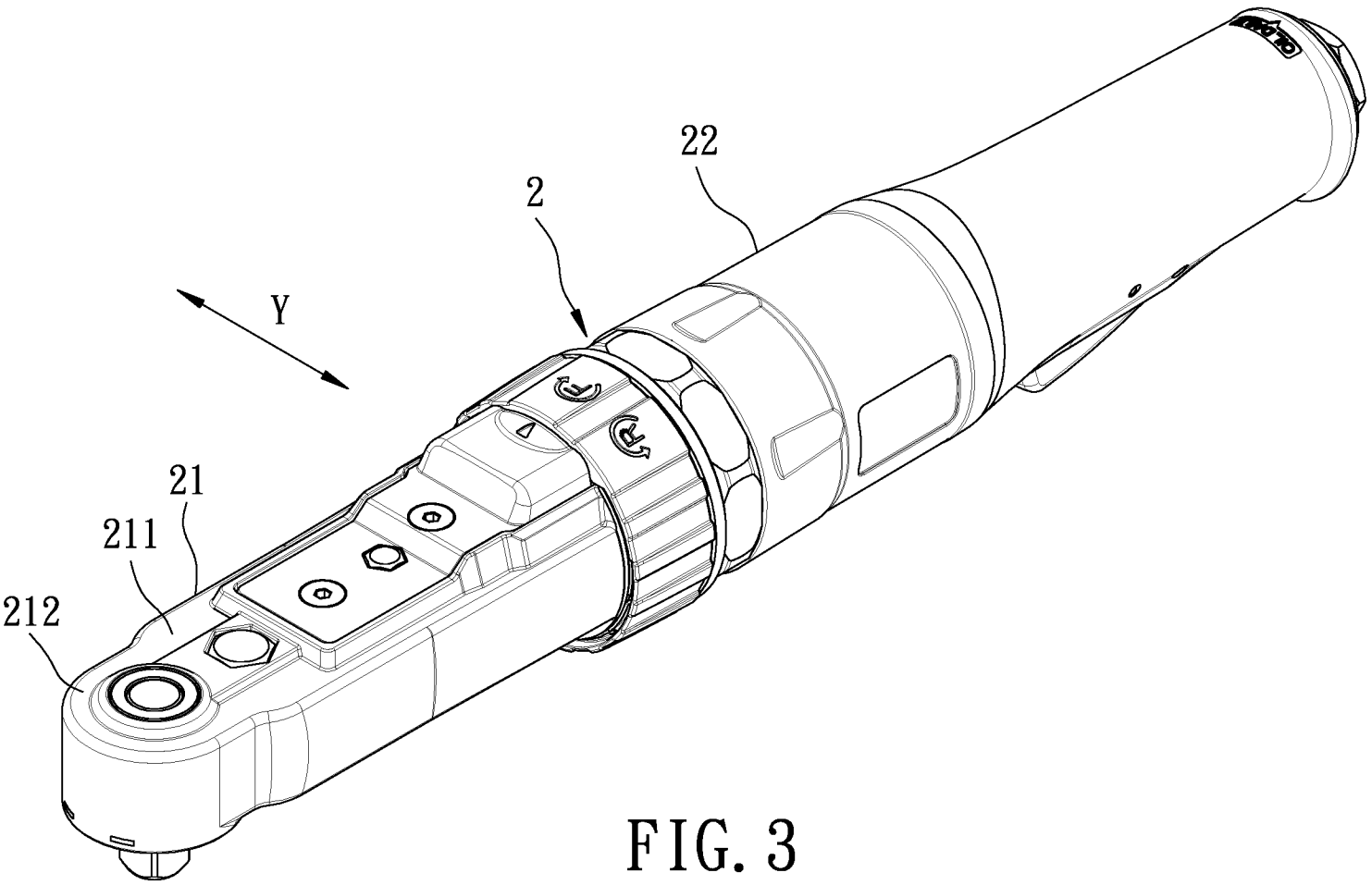
FIG. 3 is a perspective view of the preferred embodiment of a pneumatic ratchet wrench according to this invention.
Figure 4:
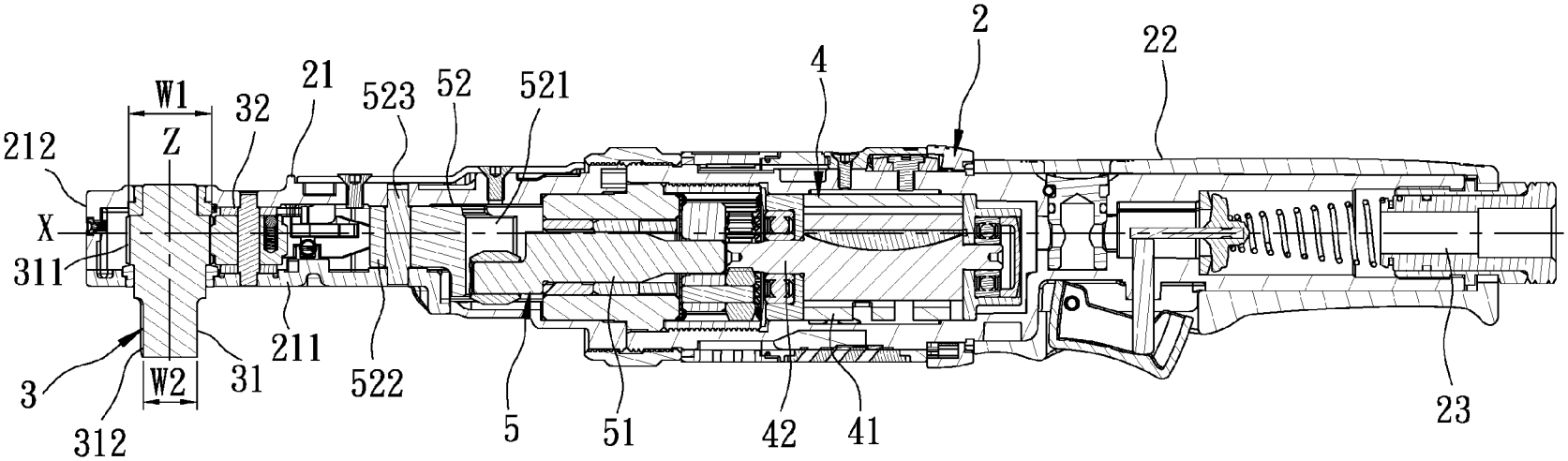
FIG. 4 is a sectional view of the preferred embodiment.
Figure 5:
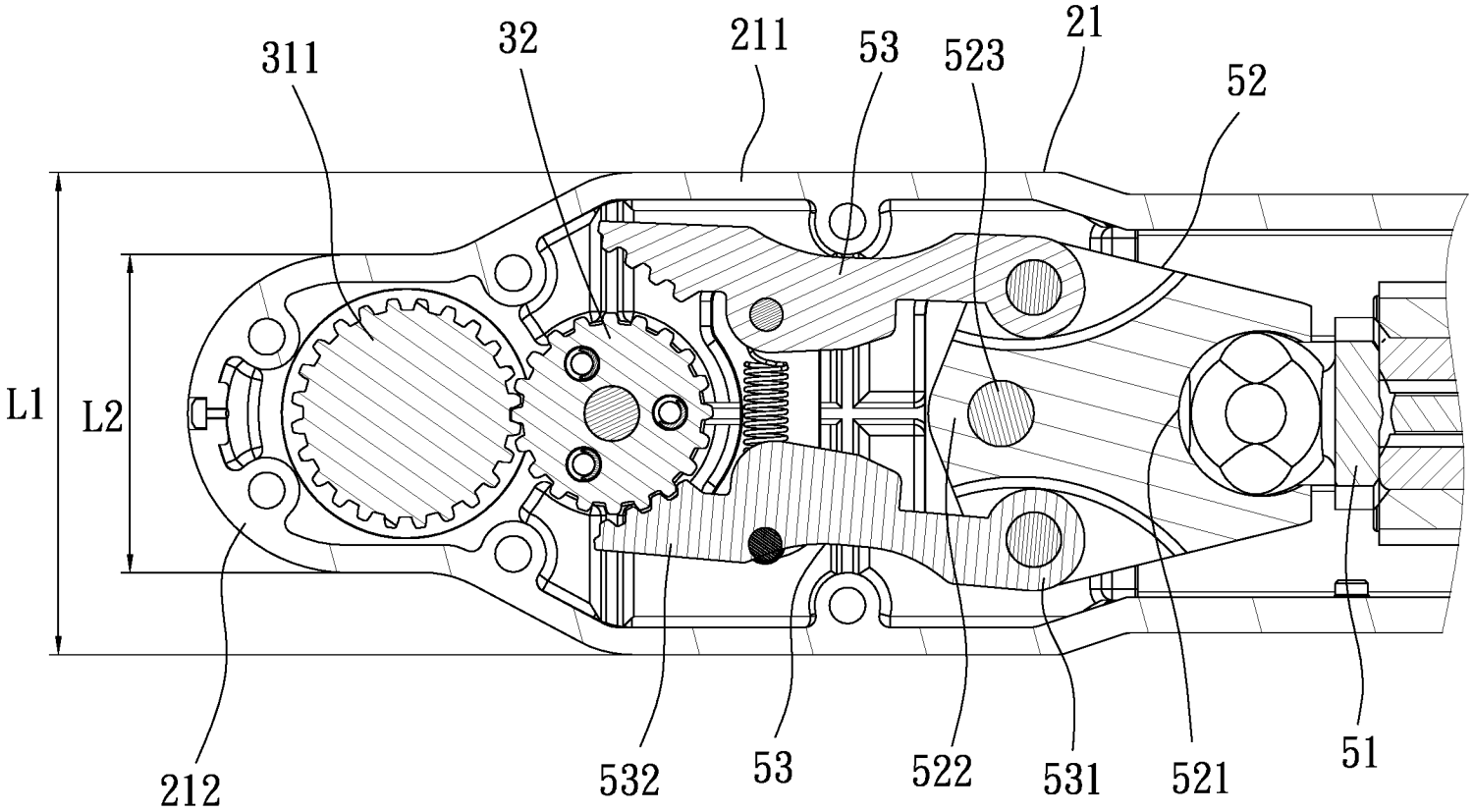
FIG. 5 is a fragmentary sectional view of the preferred embodiment.

Referring to FIGS. 3, 4, and 5, the preferred embodiment of a pneumatic ratchet wrench according to this invention includes a main body 2, an output unit 3, a driving unit 4, and a transmission unit 5.

The main body 2 has a front handle portion 21 extending along an X-axis parallel to a longitudinal direction of the main body 2, a rear handle portion 22 that is opposite to the front handle portion 21 and that can be gripped, an intake passage 23 formed in the rear handle portion 22 for guiding inflow of air. The front handle portion 21 has a handle section 211, and a shrunk head section 212 disposed in front of the handle section 211. The handle section 211 has a width (L1) along a Y-direction perpendicular to the X-axis, which is greater than that of the shrunk head section 212. The ratio of the width of the handle section to that of the shrunk head section ranges between 1:0.7 and 1:0.875. In this embodiment, the ratio of the width of the handle section to that of the shrunk head section is 1:0.875.

The output unit 3 is disposed within the front handle portion 21 of the main body 2, and includes a driving head 31 rotatable about a Z-axis perpendicular to the X-axis and the Y-axis direction and disposed entirely within the shrunk head section 212 for outputting a power, and a reverse gear 32 disposed pivotally in the handle section 211. The driving head 31 has a gear portion 311 meshing with the reverse gear 32, and a driving portion 312 having a polygonal cross-section and formed integrally with the gear portion 311. The maximum width (W1) of the gear portion 311 is greater than the maximum width (W2) of the driving portion 312.

The driving unit 4 is disposed in the rear handle portion 22, and includes a cylinder 41 in fluid communication with the intake passage 23 for guiding inflow and outflow of air, and a rotor 42 disposed within the cylinder 42 and driven pneumatically to rotate.

The transmission unit 5 is disposed in the main body 2, and includes an eccentric shaft 51 connected to an end of the rotor 42, a yoke 52 connected to the eccentric shaft 51, and two racks 53 connected to the yoke 52. The yoke 52 has a notch 521 disposed at an end thereof and permitting extension of the eccentric shaft 51 therein, a connecting portion 522 disposed at an opposite end thereof, and a pivot shaft 523 extending through the connecting portion 522 for connecting the connecting portion 522 pivotally to the handle section 211 of the front handle portion 21 in a direction parallel to the Z-axis. Each of the racks 53 has a pivotal end 531 connected pivotally to the connecting portion 522 of the yoke 52, and a meshing portion 532 for meshing with the reverse gear 32.

It should be noted that, the racks 53 are controlled by a switching device (not shown) such that, when the meshing portion 532 of one of the racks 53 meshes with the reverse gear 32, the other of the racks 53 is removed from the reverse gear 32.

When the eccentric shaft 51 is driven by the rotor 42 to rotate about the X-axis, the yoke 52 is swung about the pivot shaft 523 to allow the racks 53 to advance alternately, such that only one of the racks 53 meshes with the reverse gear 32 at a time. Since only one of the racks 53 can be brought into engagement with the reverse gear 32, the reverse gear 32 together with the gear portion 311 of the driving head 31 is rotated in a single direction (i.e., a selected one of a clockwise direction and a counterclockwise direction), thereby allowing the driving head 31 to output a power.

Alternatively, a minor portion of the output unit 3 may extend into the handle section 211, that is, the major portion of the output unit 3 is disposed within the shrunk head section 212.

In view of the above, since the reverse gear 32 and the racks 53 are disposed in the handle section 211, only the driving head 31 is disposed in the shrunk head section 212. As such, the width (L2) of the shrunk head section 212 can be reduced largely, so that the pneumatic ratchet wrench is suitable for operation in a narrower space, and thus is convenient to use.

With this invention thus explained, it is apparent that numerous modifications and variations can be made without departing from the scope and spirit of this invention. It is therefore intended that this invention be limited only as indicated by the appended claims.

We claim:

1. A pneumatic ratchet wrench comprising:

a main body extending along a longitudinal direction and having a handle section and a shrunk head section disposed in front of said handle section, said handle section having a width greater than that of said shrunk head section;

an output unit including a driving head rotatable about a Z-axis perpendicular to the longitudinal direction for outputting a power, at least major portion of said output unit being disposed within said shrunk head section;

a driving unit disposed in said main body for generating the power pneumatically; and a transmission unit disposed within said handle section and spaced apart from said driving head for transmitting the power to said driving head, wherein, said output unit further includes a reverse gear disposed in said handle section and geared to said driving head, said reverse gear being controlled by said transmission unit to rotate in a selected one of a clockwise direction and a counterclockwise direction, and wherein said driving unit includes a rotor rotatable about an X-axis parallel to the longitudinal direction, said transmission unit including:

an eccentric shaft connected to an end of said rotor, a yoke having a notch disposed at an end thereof and connected to said eccentric shaft, cooperation of the notch with said eccentric shaft operable to convert rotation of said rotor into swinging movement of said yoke, and two racks connected to said yoke and advanced alternately in such a manner that only one of said racks meshes with said reverse gear at a time, the two racks connected to one another by a coil spring located proximate the reverse gear.

2. The pneumatic ratchet wrench as claimed in claim 1, wherein said driving head has a gear portion meshing with said reverse gear.

3. The pneumatic ratchet wrench as claimed in claim 2, wherein said driving head further has a driving portion formed integrally with said gear portion and having a polygonal cross-section, said gear portion having a maximum diameter greater than that of said driving head.

4. The pneumatic ratchet wrench as claimed in claim 1, wherein said driving unit further includes a cylinder for guiding inflow and outflow of air, said rotor being driven pneumatically to rotate in said cylinder.

5. The pneumatic ratchet wrench as claimed in claim 1, wherein a ratio of the width of said handle section to that of said shrunk head section ranges between 1:0.7 and 1:0.875.

* * * * *